US006412915B1

(12) United States Patent
Muramatsu et al.

(10) Patent No.: US 6,412,915 B1
(45) Date of Patent: Jul. 2, 2002

(54) INK JET RECORDING HEAD, AND INK JET RECORDING APPARATUS EMPLOYING THE SAME

(75) Inventors: Hiroyuki Muramatsu; Seiji Kuwahara; Tokuya Akase; Kouji Kawaguchi; Tatsuru Sato, all of Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 09/456,619

(22) Filed: Dec. 8, 1999

(51) Int. Cl.[7] ..... B41J 2/06
(52) U.S. Cl. ..... 347/55
(58) Field of Search ..... 347/55, 151, 120, 347/141, 154, 103, 123, 111, 159, 129, 128, 131, 125, 158; 399/271, 290, 292, 293, 294, 295

(56) References Cited

U.S. PATENT DOCUMENTS 6,155,672 A * 12/2000 Suetsugu et al. ..... 347/55

FOREIGN PATENT DOCUMENTS

| | | |
|---|---|---|
| JP | 1190459 | 7/1989 |
| JP | 1195052 | 8/1989 |
| JP | 5208501 | 8/1993 |

* cited by examiner

*Primary Examiner*—Raquel Yvette Gordon
(74) *Attorney, Agent, or Firm*—Adams & Wilks

(57) ABSTRACT

In an ink jet recording head for an ink jet recording apparatus, insulating members are arranged between adjacent ones of a plurality of recording electrodes so that electric discharge is made less likely to occur across the recording electrodes. Thus, even where the density of the recording electrodes in the head is set high in order to achieve high resolution, ink can be stably jetted. Further, the ink can be supplied to the front end of the head without increasing a static pressure which acts on the ink in such a manner that the insulating members are disposed only in the vicinities of the front ends of the recording electrodes while the discharge withstand voltage across the adjacent recording electrodes is increased.

15 Claims, 6 Drawing Sheets

INK JET RECORDING HEAD, AND INK JET RECORDING APPARATUS EMPLOYING THE SAME

BACKGROUND OF THE INVENTION

The invention relates to an ink jet recording apparatus. More particularly, it relates to an ink jet recording apparatus for obtaining on recording paper, output images capable of meeting needs in a wide range from the printing business world in which the high speed output of a high quality image is required, to the printer industry which manufactures printers on the basis of office and personal requirements, as well as the consumer goods industry which manufactures inexpensive general-purpose output equipment employing various recording paper.

Shown in FIGS. 6 and 7 are examples of ink jet recording apparatuses which are used for an electrostatic acceleration type ink jet recording system in the conventional art.

Referring to FIG. 6, a slit 200 is formed by flat members 100 and 101, and it is filled up with ink 30. The ink 30 in the slit 200 undergoes a static pressure by ink 30 stored in an ink container 900, and it forms a semicircular convex surface, namely, a meniscus in the slit 200. An array of recording electrodes 40 is arranged on the inner surface of the flat member 101, while recording paper 50 and a counter electrode 60 are arranged at a position which confronts the recording electrode array 40 through a space. Each recording electrode of the recording electrode array 40 is connected at one end to the corresponding one of recording power sources 700, and is terminated at the other end in the vicinity of the slit-shaped ink jetting port 200. When a high voltage pulse is induced in any of the recording electrodes 40, the ink 30 existing near the specific recording electrode 40 flies toward the counter electrode 60 in the form of an ink droplet until it adheres to the recording paper 50 so as to form a pixel. Herein, the density of the recording electrodes 40 arrayed in the lengthwise direction of the slit 200 determines the line density of a recorded image. (Refer to Japanese Patent Application Publication No. 49189/1983.)

FIG. 7 is a perspective view showing the ink jet recording apparatus in the conventional art. Referring to FIG. 7, a plurality of recording electrodes 40 are disposed within a head. Ink is jetted by applying a voltage to a counter electrode 60 and selectively applying a high voltage only to the recording electrode 40 lying at a position nearest a desired ink jetting position so as to enlarge the potential difference of the specific recording electrode 40 relative to the counter electrode 60. Herein, the large number of electrodes 40 are arrayed dividing the space between an upper plate 12*a* and a lower plate 12*b*, so that openings 11 are formed at predetermined intervals. When ink not shown is poured into the openings 11, the electrodes 40 become wet with the ink. Therefore, the partitioned openings 11 are concealed, and the ink forms a continuous meniscus. When, in such a state, a high voltage pulse is impressed on the selected ones of the plurality of recording electrodes 40 while scanning these electrodes, ink droplets are jetted only from the vicinities of the positions of the selected recording electrodes. (Refer to Japanese Patent Application Publication No. 16825/1987.)

However, problems to be stated below are involved in the ink jet recording heads and the ink jet recording apparatuses which conform to the electrostatic acceleration type ink jet recording system in the conventional art.

In a case where the intervals of the plurality of recording electrodes disposed within the head are set sufficiently small in order to attain a high resolution, electric discharge is liable to occur across the adjacent recording electrodes due to the impression of the predetermined voltage pulse on the recording electrodes in a printing mode. Therefore, the voltage to be applied to the recording electrodes must be set lower than the voltage for jetting the ink. In consequence, the ink is not jetted, and the desired printing cannot be done.

Even with the construction wherein the plurality of electrodes are arrayed dividing the space between the upper plate and lower plate of the head so as to partition the openings, in the case where the intervals of the plurality of recording electrodes disposed within the head are set sufficiently small in order to attain a high resolution, the phenomenon of electric discharge similarly arises across the plurality of recording electrodes through the ink, and the desired printing cannot be done.

SUMMARY OF THE INVENTION

It is accordingly an object of the present invention to provide an ink jet recording apparatus in which, even when the intervals of a plurality of recording electrodes disposed within a head are set sufficiently small in order to attain a high resolution and when a predetermined voltage pulse necessary for jetting ink is impressed on the recording electrodes in a printing mode, the ink can be stably jetted without incurring electric discharge across the adjacent recording electrodes.

The present invention consists in an ink jet recording head having, at least, an opening; a supporting frame which forms a liquid chamber communicating with the opening and storing ink therein; a plurality of recording electrodes which are arranged near the opening; a counter electrode which is arranged at a position confronting the recording electrodes through a minute gap; and a power source circuit which applies a voltage across the recording electrodes and the counter electrode; characterized in that members having an electrically insulating property are arranged between the recording electrodes.

Further, the insulating members are arranged near the opening.

Still further, the insulating members are arranged in parallel with the recording electrodes on the supporting frame.

Yet further, the insulating members are arranged at a front end of the opening, and a region of the each insulating member is so shaped as to enlarge confronting the counter electrode.

In addition, the insulating members are arranged so as to lie nearer a front end of the opening than the recording electrodes, in the vicinity of the opening.

Besides, an ink jet recording apparatus according to the present invention consists in comprising the ink jet recording head; supply means for supplying the ink into the opening; a recording medium being arranged between the counter electrode and the opening; and a conveyance mechanism which conveys the recording medium.

In this manner, according to the present invention, the insulating members are disposed among the plurality of recording electrodes, whereby the electric discharge across the selected and non-selected ones of the recording electrodes is made less liable to occur. Thus, even in a case where the density of the recording electrodes in the head is set high in order to accomplish a high resolution, the ink can be stably jetted.

DETAILED DESCRIPTION OF THE PREFERRED EMBODIMENTS

In an ink jet recording apparatus according to the present invention, insulating members are interposed between the adjacent ones of a plurality of recording electrodes arranged in a head. Thus, in a case where the density of the recording electrodes is set sufficiently high in order to print an image of high quality, a voltage which is high enough to jet ink can be applied across the selected recording electrode and a counter electrode, and the ink can be jetted stably without incurring interelectrode discharge across the selected and nonselected recording electrodes.

In addition, the insulating members can be arranged so as to partition all the recording electrode portions in order to enhance a discharge withstand voltage, or they can also be arranged only near the front ends (i.e., outer ends) of the recording electrodes in order to facilitate the inflow of the ink into an opening. Besides, the insulating members can also be shaped so as to enlarge at the front ends of the recording electrodes, thereby to enhance the discharge withstand voltage especially at the front ends of the recording electrodes.

Moreover, considering the electric discharge at the front ends of the recording electrodes, the insulating members can be arranged so as to lie nearer the front end of the opening than the recording electrodes.

[Embodiment 1]

One embodiment of an ink jet recording apparatus according to the present invention will be described with reference to FIGS. 1 and 2.

Figure 1:
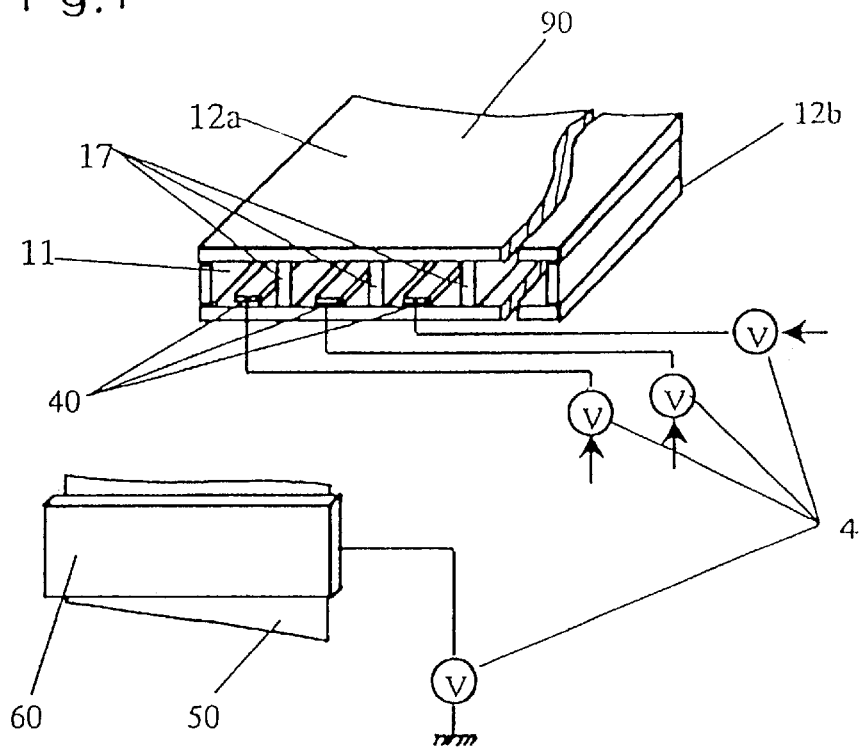
FIG. 1 is an explanatory view showing the structural and positional relationships of a recording head, recording paper and a counter electrode in each of the first~fourth embodiments of the present invention.

FIG. 1 is a perspective view which shows the arrangement of an ink jet recording head, a counter electrode and recording paper in the ink jet recording apparatus in the first embodiment of the present invention. FIG. 2 is a plan view in which the arrangement of the recording electrodes and electrically insulating members of the ink jet recording head 90 in the ink jet recording apparatus is seen from the top surface of the recording head depicted in FIG. 1.

First, the constituents of the ink jet recording apparatus of this embodiment will be described.

Referring to FIG. 1, the lengthwise direction of an opening 11 is set to be a main scanning direction, while the widthwise direction of the opening 11 is set to be a sub scanning direction. Then, a plurality of recording electrodes 40 made of aluminum (Al) are arranged at regular intervals in the main scanning direction on a lower head plate 12*b*. Further, electrically insulating members 17 are arranged on the lower head plate 12*b* so as to be arrayed in the main scanning direction alternately with the recording electrodes 40. An upper head plate 12*a* is disposed on the insulating members 17, thereby to form the opening 11. The opening 11 is held in communication with an ink chamber not shown. The recording electrodes 40 are electrically connected to power sources 4, and a voltage corresponding to an image signal can be applied to the selected ones of the plurality of recording electrodes 40.

A counter electrode 60 is arranged with a predetermined gap spaced from the opening 11, and recording paper 50 is fed between the counter electrode 60 and the opening 11 by a paper conveyance system not shown. A value of 0.3 [mm] to 1 [mm] is suitable as the gap. The counter electrode 60 is connected to a power source 4, and a voltage at a potential different from that of the recording electrodes 40 can be applied to the counter electrode 60. The recording paper 50 may be conventional plain paper. It is also possible to employ a non-paper material such as OHP (overhead projector) film.

The upper head plate 12*a* and the lower head plate 12*b* should desirably be made of glass, silicon (Si) or the like in order to accurately define the shape of the opening 11. In an example of this embodiment, glass (having a volume resistivity of $1.0\times10^{15}$ [Ω·cm]) was used.

In the example, the recording electrodes 40 was patterned in such a way that aluminum was deposited on a substrate by vacuum evaporation, and that the resulting aluminum thin film was thereafter subjected to chemical etching. The number of the recording electrodes is not especially restricted, but it is governed by the capability of a driver IC (integrated circuit) which switches the recording electrodes. Besides, the recording electrodes 40 should suitably have a pitch of 50~150 [μm], and they were fabricated at a pitch of 140 [μm] in the example.

In the example of this embodiment, aluminum was employed as the material of the recording electrodes 40. Needless to say, however, the material is not especially restricted, but a metal material such as copper (Cu), chromium (Cr), gold (Au) or nickel (Ni) may well be employed.

Besides, insofar as the surface of the counter electrode 60 confronting the opening 11 is parallel to this opening, any other shape is not especially restricted. In the example, the counter electrode 60 was made of stainless steel difficult of corrosion and difficult of flawing, it may well be made of a metal material such as aluminum or copper.

Next, the conditions of the ink for use in the present invention will be explained.

Regarding the properties of the ink, a surface tension, a viscosity and an electric conductivity are mentioned as factors which are greatly contributive to ink discharge. The surface tension and the maximum path length of the ink to be jetted toward the counter electrode 60 (hereinbelow, termed the "maximum recordable path length") relate so that the latter increases with decrease in the former within a surface tension range of 20~50 [dyn/cm], assuming that the conductivity and the viscosity are constant. Accordingly, as the surface tension is lower, a resisting force which acts on the ink in an ink jetting process becomes weaker, and the ink can be jetted even with a weaker electric field, so that the maximum recordable path length can be enlarged more. The surface tension is, in general, high in water ink. The surface tension of pure water is 72.8 [dyn/cm] (at 20° C.), and those of organic solvents are 20 [dyn/cm] to 35 [dyn/cm].

Therefore, ink prepared by dissolving a dye in an organic solvent is usable as the ink in the present invention. Moreover, the maximum recordable path length can be increased in such a way that the surface tension is improved by dissolving a surface-active agent, such as anionic surfactant, cationic surfactant or nonionic surfactant, in the above ink.

The viscosity of the above ink solvent can be set in a wide range. Since, however, a solvent of low viscosity exhibits a high volatility, the ink is poorly kept, and a solvent whose boiling point falls within a range of at least 200[° C.] is selected in order to ensure the keeping of the ink. Assuming that the surface tension and the conductivity are constant, the viscosity and the maximum recordable path length relate so that the latter increases with decrease in the former. As in the case of the surface tension, therefore, when the viscosity is low, the resisting force which acts on the ink in the ink jetting process becomes weak, and hence, the maximum recordable path length can be enlarged.

It is necessary for jetting the ink to electrically charge the ink at the recording electrodes 40 of the head. Therefore, the conductivity of the ink should desirably be low. Ink having a volume resistivity of $1.0\times1.0^{7}\sim1.0\times10^{9}$ [Ω·cm] was used in the example of this embodiment.

Incidentally, regarding the set values of the ink properties, whether or not the flight of the ink is appropriate depends upon the value of a voltage applied across the common counter electrode and each recording electrode, the distance between the recording electrodes and the counter electrode, the width of the jet opening, etc. Needless to say, therefore, the optimum ranges of the properties such as the surface tension, viscosity and electric conductivity are not always restricted to the value s mentioned above.

Besides, the ink is supplied from the ink chamber into the opening 11 by ink supply means not shown, under a substantially constant pressure which is based on the weight of the ink itself and the atmospheric pressure. The static pressure acting on the ink balances with the surface tension of the ink in the opening 11 and forms a semicircular convex surface, namely, a meniscus, and it holds this state. The static ink pressure required therefor is determined by the area of the opening 11, the viscosity of the ink, etc.

The voltages to be applied to the recording electrodes 40 and the counter electrode 60 are controlled in accordance with an image signal by the switching circuit not shown. A Coulomn force is bestowed on the ink by the potential difference between the counter electrode 60 and each of the selected recording electrodes 40, and the ink is jetted from the opening 11 toward the counter electrode 60 in the vicinity of the selected recording electrode.

In this way, dots are recorded on the recording paper 50. After one line of the recording head has been printed, the recording paper 50 is further moved in the sub scanning direction by a predetermined amount by means of the paper feed mechanism not shown, and the above operation is repeated. Thus, a recorded image is finally formed. Furthermore, a color image can be depicted on the recording paper 50 in such a way that a plurality of ink jet recording heads as shown in FIG. 1 are prepared, and that the respective heads are caused to jet inks of different colors, so as to be superposedly print a plurality of dots of the respectively different colors.

Figure 2:
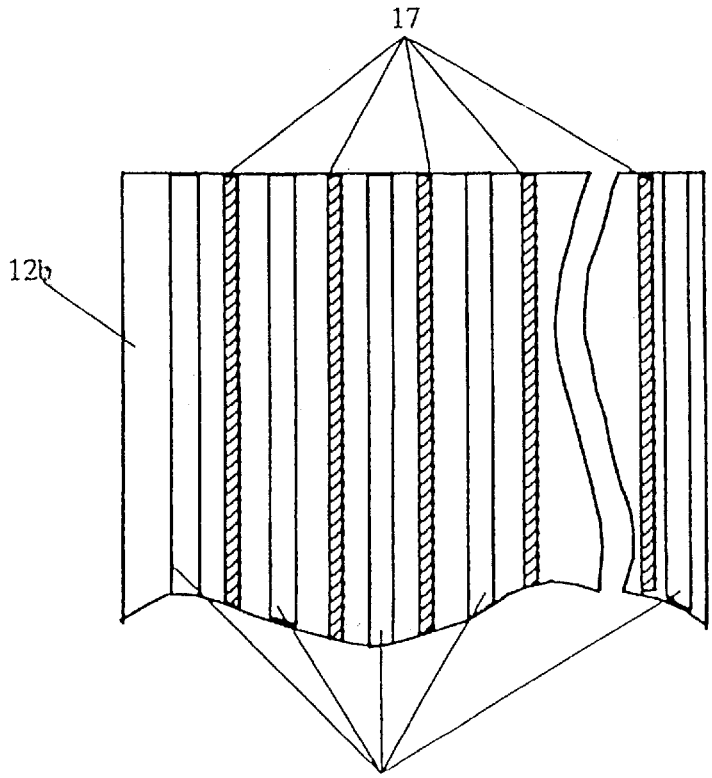
FIG. 2 is a plan view showing the arrangement of the electrodes and electrically insulating members of the recording head in the first embodiment of the present invention.

FIG. 2 is the plan view in which the arrangement of the recording electrodes 40 and the electrically insulating members 17 in the head 90 is seen from the top surface of this embodiment shown in FIG. 1, with the upper head plate 12*a* omitted from illustration. In FIG. 2, the sheet of the drawing corresponds to the plane of the counter electrode 60. As shown in FIG. 2, the insulating members 17 are held between the respectively adjacent recording electrodes 40 and are arranged in parallel with the recording electrodes 40 in the lengthwise direction of the opening 11. In the example of this embodiment, the recording electrodes 40 and the insulating members 17 were arrayed alternately at equal intervals in the lengthwise direction of the opening 11, but the equal intervals are not especially required.

Besides, the length of each insulating member 17 is equal to or greater than that of each recording electrode 40 in the lengthwise direction of the recording electrodes 40. Owing to such a contrivance, the phenomenon of electric discharge across the respectively adjacent recording electrodes is difficult to arise through the ink in the head.

In the example of this embodiment, the insulating members 17 were formed on the lower head plate 12*b* by depositing an acrylic resist as insulating films. By way of example, however, films of polyimide may well be respectively bonded onto the upper plate 12*a* and lower plate 12*b* so as to be held therebetween.

In case of a comparative example where ink having a volume resistivity of $1.0\times10^{9}$ [Ω·cm] was used when the spacing between the upper head plate 12*a* and the lower head plate 12*b* was 30 [μm], the distance between the respectively adjacent recording electrodes 40 was 70 [μm], the width of each recording electrode 40 was 70 [μm], the thickness of each recording electrode 40 was 1 [μm], and the voltages applied to the recording electrodes 40 and to the counter electrode 60 were −700 [V] and 1500 [V], respectively, the phenomenon of electric discharge across the recording electrodes 40 arose through the ink in the vicinities of the front ends (i.e., outer ends) of these recording electrodes, and the ink was not jetted.

On the other hand, the insulating members 17, which were made of the acrylic resist and each of which had the dimensions of a width of 60 [μm] and a height of 30 [μm] equal to the spacing between the upper plate 12*a* and lower plate 12*b* of the head, were arranged between the respectively adjacent recording electrodes 40. Then, the phenomenon of electric discharge across the adjacent recording electrodes 40 did not arise even when the voltages to be applied to the recording electrodes 40 and the counter electrode 60 were respectively set at −1000 [V] and 1500 [V] to increase the potential difference therebetween, in the electrode arrangement conditions as stated above.

[Embodiment 2]

Another embodiment of an ink jet recording apparatus according to the present invention will be described with reference to FIGS. 1 and 3.

Figure 3:
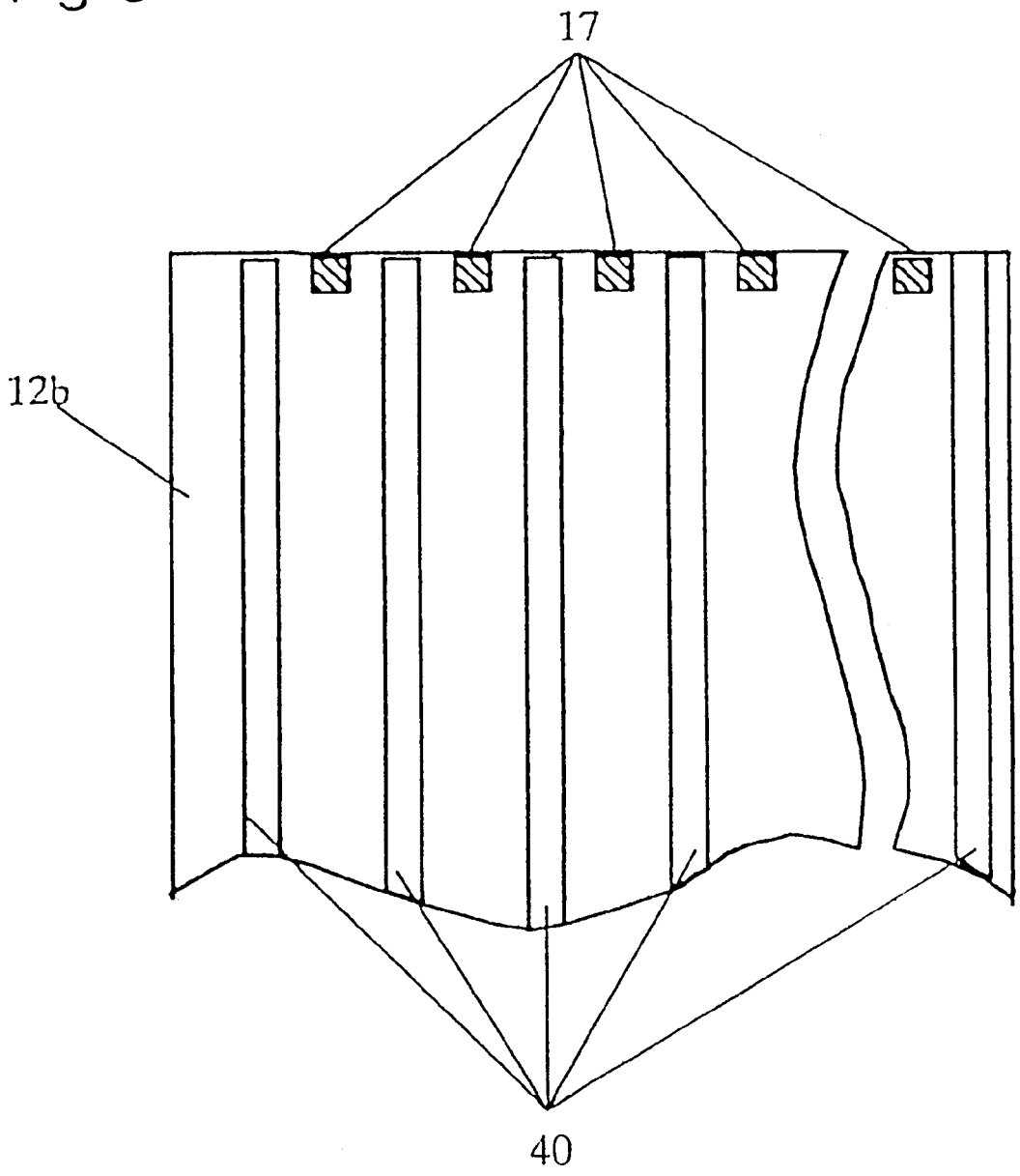
FIG. 3 is a plan view showing the arrangement of the electrodes and insulating members of the recording head in the second embodiment of the present invention.

FIG. 3 is a plan view in which the arrangement of the recording electrodes 40 and electrically insulating members 17 of a recording head in the ink jet recording apparatus is seen from the top surface of the recording head depicted in FIG. 1, with an upper head plate 12*a* omitted from illustration. Except for the arrangement of the recording electrodes 40 and the insulating members 17, the construction of this embodiment is the same as that of Embodiment 1.

The electric discharge across the adjacent ones of the recording electrodes 40 is liable to occur in a place, such as the front ends (i.e., outer ends) of the electrodes, where electric lines of forces are prone to crowd. In this embodiment, the insulating members 17 are arranged especially at those front ends of the recording electrodes 40 at which the phenomenon of electric discharge is liable to arise.

In this manner, the insulating members 17 are interposed between the adjacent recording electrodes 40 only at the front end of the head and are arranged at equal intervals in the lengthwise direction of an opening 11. Thus, ink can be supplied to the front end of the opening 11 under a low back pressure while the discharge withstand voltage across the adjacent electrodes 40 is heightened in the head.

[Embodiment 3]

Still another embodiment of an ink jet recording apparatus according to the present invention will be described with reference to FIGS. 1 and 4.

Figure 4:
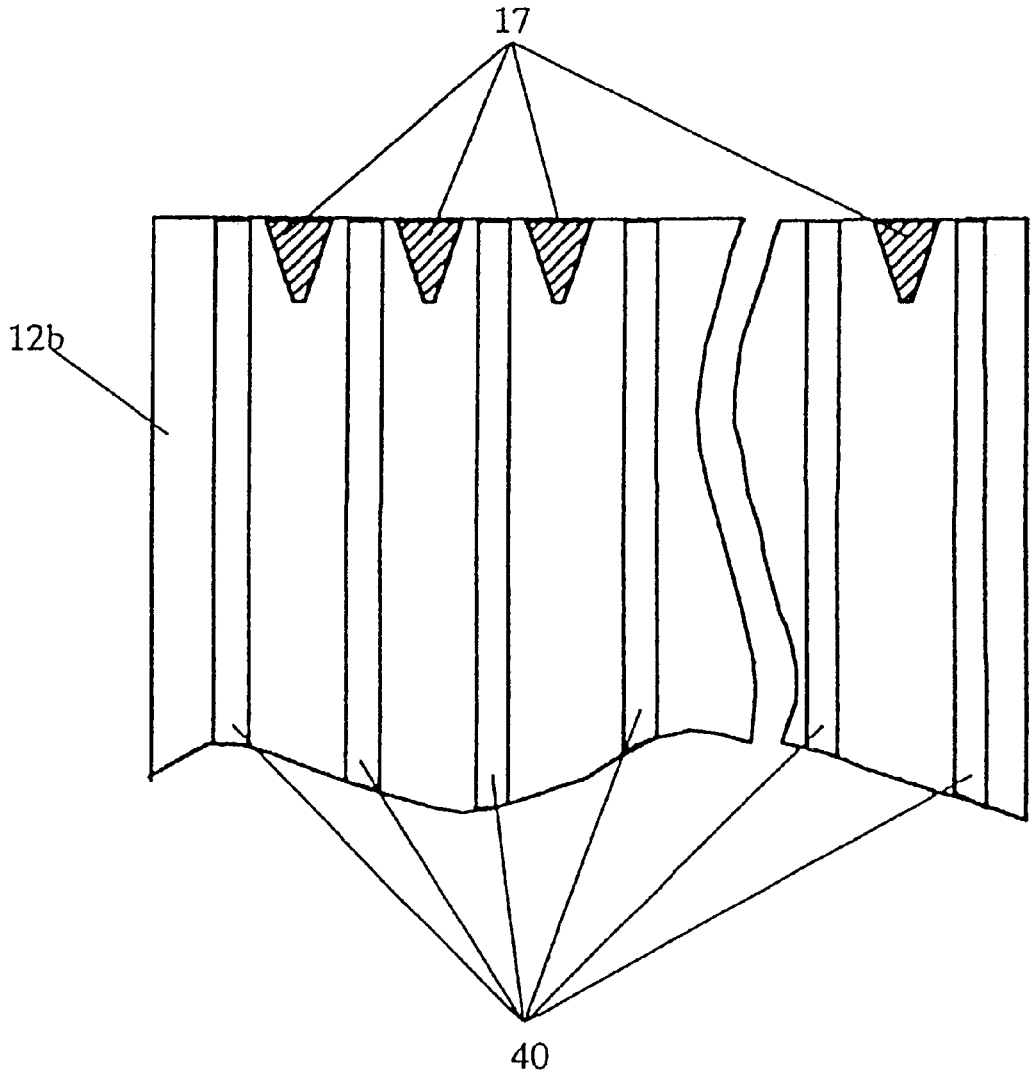
FIG. 4 is a plan view showing the arrangement of the electrodes and insulating members of the recording head in the third embodiment of the present invention.

FIG. 4 is a plan view in which the arrangement of the recording electrodes 40 and electrically insulating members 17 of a recording head in the ink jet recording apparatus is seen from the top surface of the recording head depicted in FIG. 1, with an upper head plate 12*a* omitted from illustration. Except for the arrangement of the recording electrodes 40 and the insulating members 17, the construction of this embodiment is the same as that of Embodiment 1.

In this embodiment, the regions of the insulating members 17 are enlarged especially at those front ends of the recording electrodes 40 at which the phenomenon of electric discharge is liable to arise. Owing to such a contrivance, a discharge withstand voltage near the front ends of the electrodes 40 is heightened.

[Embodiment 4]

Yet another embodiment of an ink jet recording apparatus according to the present invention will be described with reference to FIGS. 1 and 5.

Figure 5:
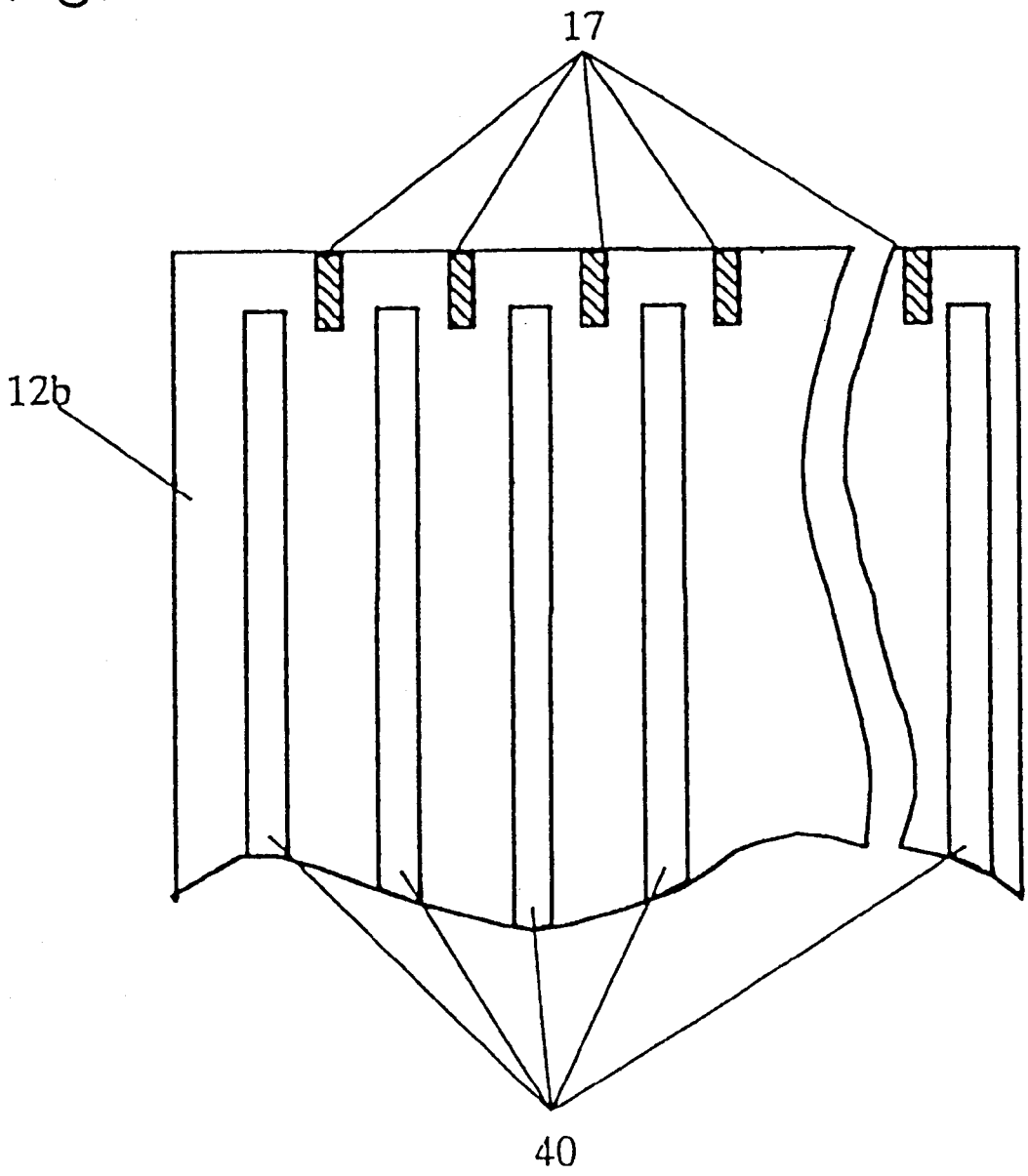
FIG. 5 is a plan view showing the arrangement of the electrodes and insulating members of the recording head in the fourth embodiment of the present invention.
Figure 6:
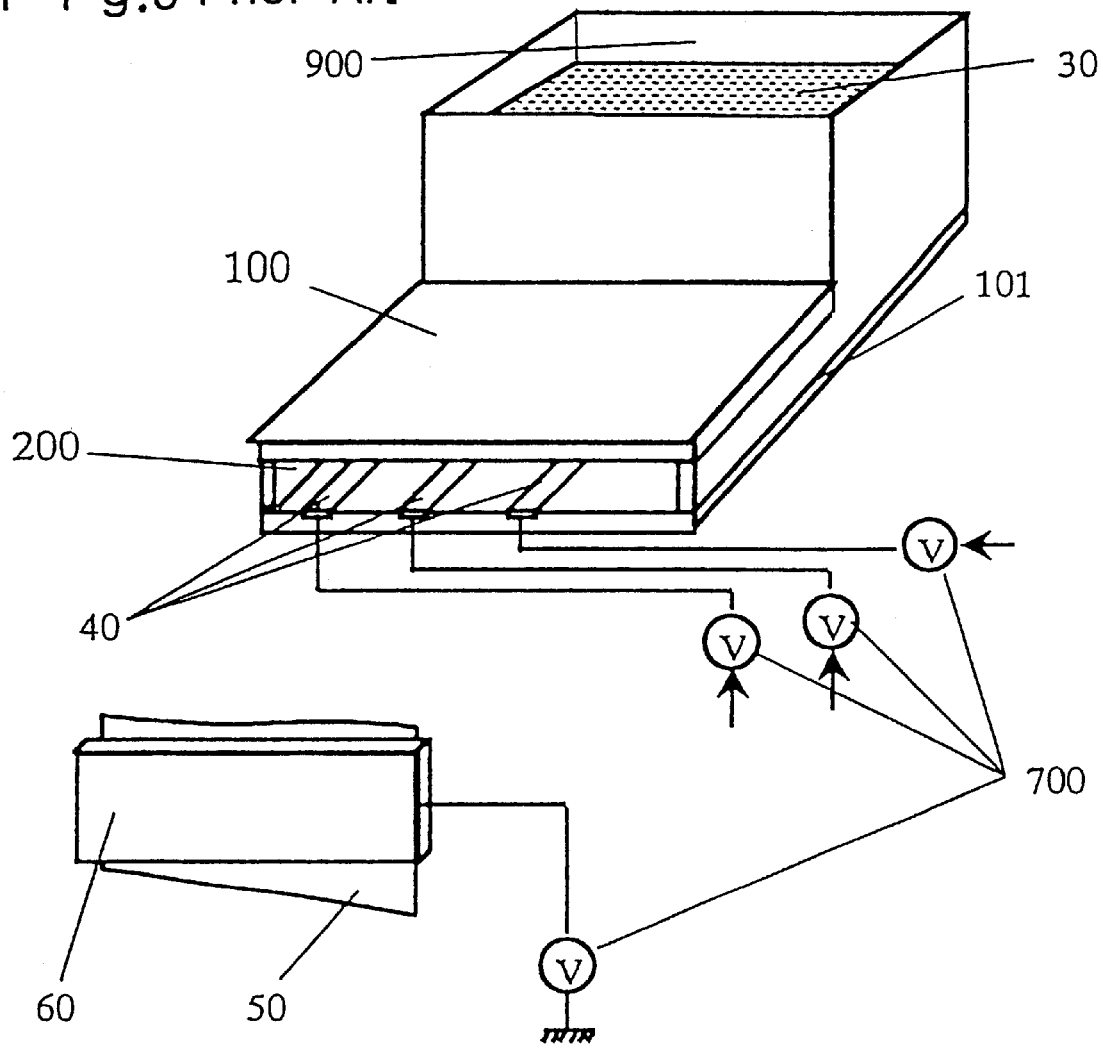
Fig.6 Prior Art
FIG. 6 is an explanatory view showing an ink jet recording apparatus in the conventional art.
Figure 7:
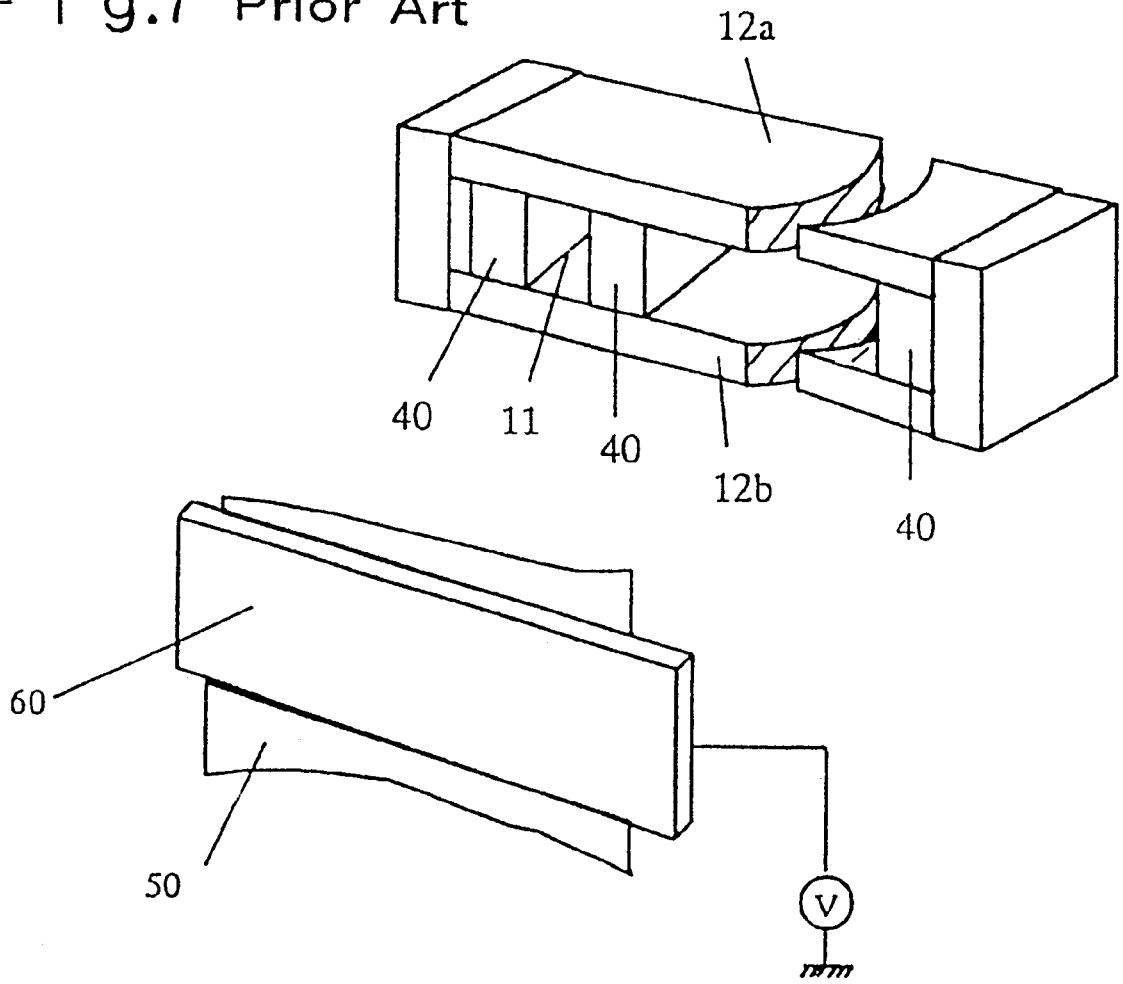
Fig.7 Prior Art
FIG. 7 is an explanatory view showing another ink jet recording apparatus in the conventional art.

FIG. 5 is a plan view in which the arrangement of the recording electrodes 40 and electrically insulating members 17 of a recording head in the ink jet recording apparatus is seen from the top surface of the recording head depicted in FIG. 1, with an upper head plate 12*a* omitted from illustration. Except for the arrangement of the recording electrodes 40 and the insulating members 17, the construction of this embodiment is the same as that of Embodiment 1.

In this embodiment, those front ends of the recording electrodes 40 at which the phenomenon of electric discharge is liable to arise are especially located inwards of the head relative to the front ends of the insulating members 17. Thus, the electric discharge across the distal ends of the electrodes 40 is made less liable to occur, and a discharge withstand voltage near the front ends of the recording electrodes 40 is heightened.

As described above, according to the invention, in an ink jet recording head for use in an ink jet recording apparatus, members having an electrical insulating property are disposed among a plurality of recording electrodes, thereby to bring forth the effect that the electric discharge across the selected and non-selected ones of the recording electrodes is made less liable to occur. Thus, even in a case where the intervals of the plurality of recording electrodes disposed in the head are set sufficiently small in order to attain a high resolution, and where a predetermined voltage pulse necessary for jetting ink in a printing mode is impressed on the recording electrodes, the ink can be jetted stably without the electric discharge across the adjacent recording electrodes, the density of dots to be printed on a recording medium such as recording paper can be enhanced, and a print output of high image quality can be produced.

What is claimed is:

1. An ink jet recording head comprising: a supporting frame from which a printing ink is transferred to a recording medium and defining an opening having a front end from which the ink is ejected and a liquid chamber communicating with the opening for storing ink therein and transferring ink to the opening; a plurality of recording electrodes disposed on a surface of the supporting frame proximate the opening and being arranged so that each recording electrode has a side surface facing a side surface of an adjacent recording electrode; a counter electrode confronting the recording electrodes so that a minute gap is formed therebetween; a power source circuit for supplying a voltage across the recording electrodes and the counter electrode to eject ink in the vicinity of the respective recording electrode from the front end of the opening; and electrically insulating members respectively arranged between adjacent recording electrodes so that an insulating member is disposed between the facing side surfaces of adjacent recording electrodes to prevent electric discharge between the respective recording electrodes.

2. An ink jet recording head according to claim 1; wherein the insulating members are arranged proximate the front end of the opening.

3. An ink jet recording head according to either one of claims 1 and 2; wherein the insulating members are arranged in parallel with the recording electrodes on the supporting frame.

4. An ink jet recording head according to claim 3; wherein the insulating members are arranged only at the front end of the opening, and each insulating member is shaped so as to enlarge in size closer to the front end confronting the counter electrode.

5. An ink jet recording head according to claim 3; wherein the insulating members are arranged so as to lie closer to the front end of the opening than do the recording electrodes.

6. An ink jet recording apparatus, comprising: the ink jet recording head according to claim 3; supply means for supplying ink to the recording head; and a conveyance mechanism for conveying the recording medium.

7. An ink jet recording head according to claim 2; wherein the insulating members are arranged only at the front end of the opening, and each insulating member is shaped so as to enlarge in size closer to the front end confronting the counter electrode.

8. An ink jet recording head according to any one of claims 1, 2 and 7; wherein the insulating members are arranged so as to lie closer to the front end of the opening than do the recording electrodes.

9. An ink jet recording apparatus, comprising: the ink jet recording head according to any one of claims 1, 2 and 7; supply means for supplying ink to the recording head; and a conveyance mechanism for conveying the recording medium.

10. A recording head for a printer, comprising: a frame defining an ink chamber for storing ink and having an opening in communication with the chamber from which ink may be dispensed onto a recording medium; a plurality of recording electrodes arranged on the frame proximate the opening and being arranged so that each recording electrode has a side surface facing a side surface of an adjacent recording electrode; a power source circuit for supplying a voltage to the recording electrodes to cause ink to be dispensed from a front end of the opening; and electrically insulating members respectively arranged between adjacent recording electrodes so that an insulating member is disposed between the facing side surfaces of adjacent recording electrodes to prevent electric discharge between the respective recording electrodes.

11. A recording head for a printer according to claim 10; further comprising a counter electrode confronting the recording electrodes so that a minute gap is formed therebetween through which the recording medium may be passed.

12. A recording head for a printer according to claim 10; wherein the insulating members are arranged proximate the front end of the opening.

13. A recording head for a printer according to claim 10; wherein the insulating members are arranged in parallel with the recording electrodes on the supporting frame.

14. A recording head for a printer according to claim 10; wherein the insulating members are arranged only at the front end of the opening, and each insulating member is shaped so as to enlarge in size closer to the front end of the opening.

15. A recording head for a printer according to claim 10; wherein the insulating members are arranged so as to lie closer to the front end of the opening than do the recording electrodes.

* * * * *